United States Patent [19]

Stewart

[11] 4,026,034

[45] May 31, 1977

[54] NEEDLE INDICATOR FOR RAIL LINER

[75] Inventor: John Kenneth Stewart, Columbia, S.C.

[73] Assignee: Canron, Inc., Phillipsburg, N.J.

[22] Filed: Sept. 8, 1975

[21] Appl. No.: 611,163

[52] U.S. Cl. ..... 33/338; 33/1 Q; 33/144

[51] Int. Cl.[2] ..... B61K 9/08; E01B 29/04

[58] Field of Search ..... 33/338, 287, 144, 1 Q, 33/228

[56] References Cited

UNITED STATES PATENTS

| | | | |
|---|---|---|---|
| 1,417,703 | 5/1922 | Waffenschmidt | 33/1 Q |
| 3,165,838 | 1/1965 | Plasser et al. | 33/338 |
| 3,314,373 | 4/1967 | Plasser et al. | 33/228 |
| 3,389,469 | 6/1968 | Plasser et al. | 33/1 Q |
| 3,557,459 | 1/1971 | Plasser et al. | 33/144 |

*Primary Examiner*—William D. Martin, Jr.

[57] ABSTRACT

An indicator mechanism for an apparatus for correcting the existing grade and horizontal alignment of railroad track in accordance with a wire reference system. The mechanism includes frame means, the position of which in use is referenced to the existing position of an adjacent section of the railroad track. Pivot means are mounted for vertical, sliding movement on the frame means and a needle indicator is mounted on the pivot means to pivot about a horizontal axis generally parallel to the rails of the railroad track. Scale means are arranged on the frame means near one end of the indicator to indicate in combination with the indicator the existing grade and horizontal alignment of the adjacent section with reference to the wire reference system. During use of the mechanism, the position of the indicator is adjusted by a reference wire of the system which contacts the indicator. Preferably, this reference wire extends through a relatively small hole in the bottom portion of the indicator. The scale means comprises two separate scales, one scale to indicate the existing grade and the other scale to indicate the horizontal alignment of the adjacent section.

12 Claims, 5 Drawing Figures

NEEDLE INDICATOR FOR RAIL LINER

BACKGROUND OF THE INVENTION

The present invention relates to apparatus for correcting both the existing grade and the horizontal alignment of railroad track in accordance with a wire reference system and, in particular, to a mechanism for such an apparatus capable of indicating to an operator both the grade and horizontal alignment of the track being or to be corrected.

It is well known to correct the horizontal alignment of railroad track with the reference point for the aligning machine being provided by one or two tensioned wires which extend generally parallel to the rails for some distance and are referenced to the existing rails. Examples of known arrangements for aligning track in this manner are shown and described in U.S. Pat. Nos. 3,050,015 dated Aug. 21, 1962, and 3,165,838 dated Jan. 19, 1965.

It is also known to correct the grade or level of railroad track with the reference point or plane for the levelling machine, usually one able to tamp the ballast, also being provided by one or two tensioned wires arranged generally parallel to the rails, taken in a vertical plane extending longitudinally of the rails. These levelling wires are also referenced to the existing rails. Examples of known arrangements for levelling track with the use of wires are described in U.S. Pat. Nos. 3,119,346 and dated Jan. 28, 1964 and 3,433,175 dated Mar. 18, 1969.

Also British Pat. No. 1,204,558 dated Dec. 20, 1968 describes a system for observing the horizontal and vertical alignment of a railroad track that employs a single reference wire in combination with horizontal and vertical scale means and an optical arrangement to project a picture of the instantaneous horizontal and vertical alignment of said track. The optical arrangement includes a number of precisely arranged mirrors and lenses. In this system the same wire is used to provide an indication of both the vertical and horizontal alignment of the track whose position is to be corrected. The described system has several disadvantages including its expense and the skill required to construct is. Such a system could also be difficult to maintain and repair and to adjust to local conditions.

Accordingly it is an object of the present invention to provide an indicator mechanism which is practical and inexpensive, can be used in conjunction with an apparatus for correcting the existing grade and horizontal alignment of railroad track, and indicates by means of only a single reference wire both the existing grade and horizontal alignment of the track.

It is a further object to provide an indicator mechanism having a single needle indicator capable of indicating on suitable scales both the existing grade and horizontal alignment of an adjacent section of track.

SUMMARY OF THE INVENTION

Accordingly the device of the invention consists of an indicator mechanism for an apparatus for correcting the existing grade and horizontal alignment of railroad track, in accordance with a wire reference system, said mechanism comprising frame means, the position of said frame means in use being referenced to the existing position of an adjacent section of the railroad track, pivot means mounted for vertical, sliding movement on said frame means, a needle indicator mounted on said pivot means to pivot about a horizontal axis generally parallel to the rails of said railroad track, means arranged on said frame means to indicate in combination with said needle indicator the existing trade and horizontal alignment of said adjacent section with reference to said wire reference system, wherein, during use of said mechanism, the position of said needle indicator is adjusted by a reference wire of said system which contacts said needle indicator.

The reference wire preferably extends through a relatively small hole in the bottom of the needle indicator. The means arranged on the frame can consist of two separate indices, one to indicate the existing grade and the other to indicate the horizontal alignment of the track. In a preferred embodiment means is provided to compensate for variations in system geometry in curved track.

Other features and advantages of the invention will be evident from the following detailed description taken in conjunction with the accompanying drawings.

BRIEF DESCRIPTION OF THE DRAWINGS

The following is a description by way of example of certain embodiments, of the invention, reference being had to the accompanying drawings in which.

DETAILED DESCRIPTION OF PREFERRED EMBODIMENT

Figure 1:
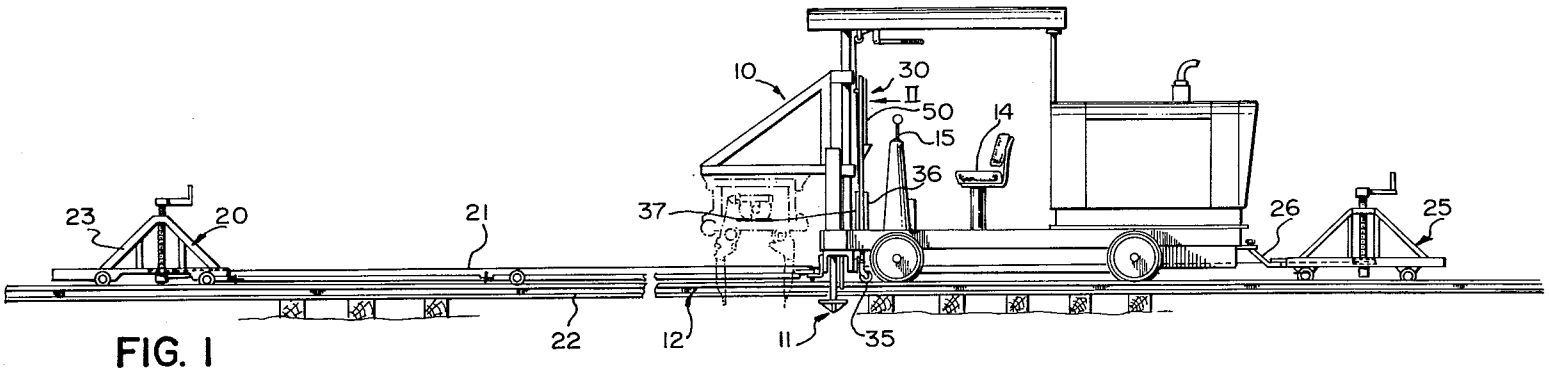
FIG. 1 is a side elevation of an apparatus for correcting the existing grade and horizontal alignment of railroad track in accordance with a wire reference system.
Figure 3:
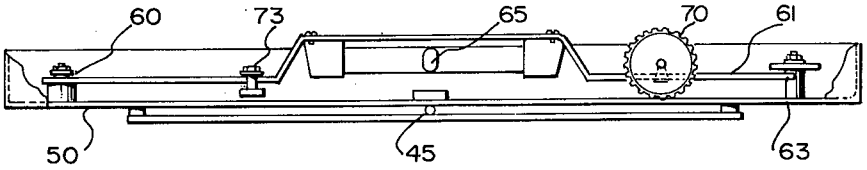
FIG. 3 is a detail plan view of the top of the indicator mechanism of FIG. 2.

In FIG. 1, there is shown a tamping machine 10 of known configuration equipped with conventional hydraulic track lifting and lining jacks 11 for correcting both the existing grade and the horizontal elignment of a section of railroad track 12. The operator of the machine 10 sits on the seat 14 where he is in a position to operate the hydraulic controls for the machine, located at 15.

Attached to the front of the machine is a conventional lightweight taut wire support system 20 for a single taut reference wire 21 which extends generally parallel to the two rails 22 of the track 12 and approximately midway between these rails in the transverse direction. At the front end of the support system 20 is lead car 23 which is provided with the usual means for holding the front end of the reference wire 21 and with conventional means for adjusting the position of the front end of the wire either vertically or horizontally as required. The car 23 is biased, as is usual, against one rail (the grade rail) by means of a spring biased wheel. The rear end of the reference wire 21 is adjustable supported on a conventional rear wire support car 25 connected to the back of the track working machine 10 by means of connecting links 26. As is usual the rear wire support car 25 is equipped with wire tensioning means to vertically and horizontally locate the rear end of the reference wire 21. The car 25 is conventionally biased against the grade rail. Thus the support system and particularly the reference wire 21 are maintained in a fixed, known position relative to the grade rail.

Figure 2:
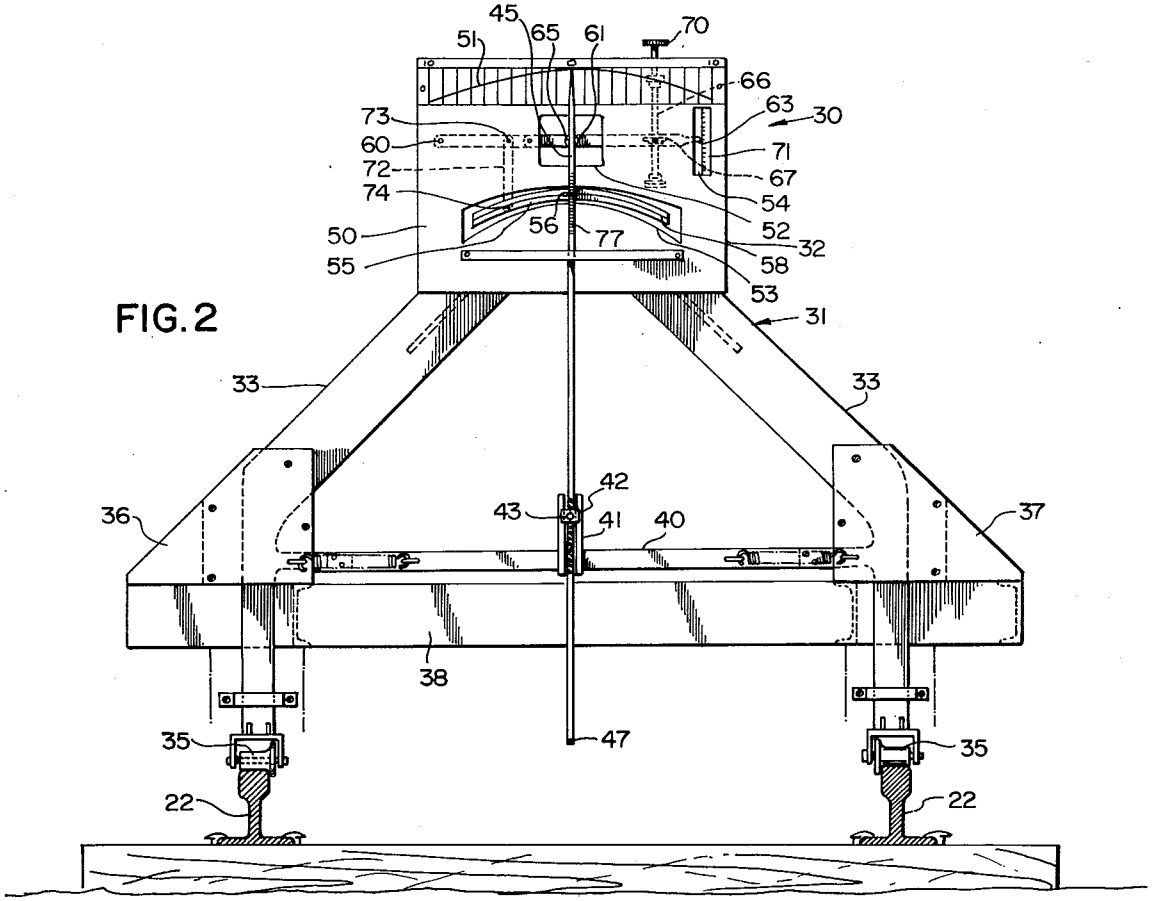
FIG. 2 is a detail in elevation of the indicator mechanism and the support therefor looking in the direction of the arrow II in FIG. 1.

In order to indicate to the machine operator what the existing position of the track being aligned by the machine is relative to the reference wire 21, the present invention provides an indicator mechanism 30, best shown in FIG. 2 of the drawings.

The indicator mechanism 30 for use with a wire reference has a reference frame 31 comprising a top member 32 supported on a pair of diverging legs 33 each terminating in a rail engaging wheel 35. The frame, in operation, rests on the rails sandwiched between front and rear pairs of guide plates 36, 37 (the rear plate of each pair is seen in FIG. 2) mounted on the machine frame 38. The reference frame 31 is pushed by the machine 10 and is biased against the grade rail in conventional fashion. The frame 31 can, if desired, be lifted by the machine and carried thereon for track travel. The cross brace 40, extending between the legs 33, carries an upstanding guideway 41 in which slides a cross-head 42 for vertical reciprocation. The cross-head 42 carries a pivot means comprising a suitable bearing 43 through which a lightweight metal needle indicator 45 passes. The needle indicator 45 which passes through the frame is provided with a wire receiving hole 47 at its lower end through which the wire 21 is threaded tightly. Thus, relative movement of the wire 21 and reference frame 31 either transversely or vertically of the track, causes the needle indicator 45 to slide up and down on the cross-head 42 in the guideway 41 or pivot clockwise or counter-clockwise about its pivot bearing 43 on the cross-head 42.

The top member 32 has a plate 50 facing the operator at the top of which is scribed a scale 51 and which is provided with three windows 52, 53 and 54. An arcuate index plate 55 is viewed through the window 53 and is pivotally connected to the top member 32 at a center point 56 of the index plate 55 by a pivot (not shown). The plate 55 has a reference line 58 scribed thereon. Pivoted at 60 to the plate 50 is a cross beam 61 which can be viewed through the window 52 and which terminates in a pointer 63 which may be viewed through the window 54. The beam 61 carries a track cross level bubble 65 which the operator can observe through the window 52 and the pivotal position of the beam 61 about its pivot point 60 may be adjusted by the screw thread 66 (mounted on the plate 50), engaging in a screw threaded collar 67 on the beam 61 and manually operated by means of a knob 70 extending above the plate 50. The window 54 is provided with a calibrated scale 71 with a center point zero and upwardly and downwardly extending graduations against which the position of pointer 63 can be read and super elevation found. To the left of the beam 61 (as seen in the drawing) is pivoted a connecting link 72, pivoted at 73 to the beam 61 and at 74 to the plate 55. The needle indicator 45 is provided with a series of numbered graudations 77.

In operation on tangent track, with the wire 21 extended well in front of and somewhat behind the machine 10 to provide a long line reference for track correction, left right alignment discrepancies in the track, at the section thereof being measured by the indicator mechanism 30, show up in the clockwise or counter-clockwise displacement of the needle pointer 45 against the calibrated scale 51 and surface discrepancies are measured by reading the calibrated graduations of the scale 77 on the needle pointer 45 against the line 58 on the arcuate plate 55. In this condition the cross level bubble 65 will show that the track is not super elevated and the pointer 63 will be against the zero position of the scale 71 as viewed through the window 54.

Figure 5:
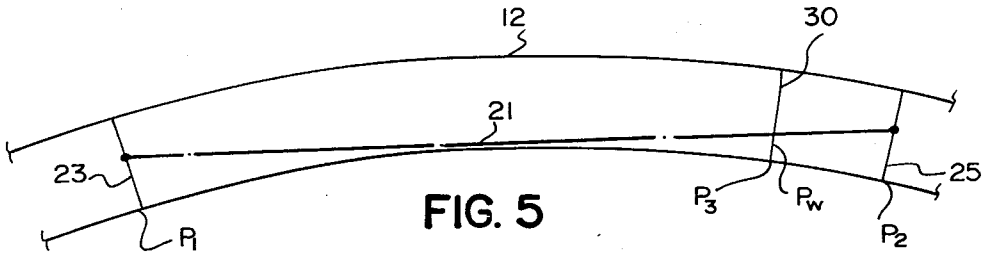
FIG. 5 is a plan view of the track section of FIG. 4 showing the geometry of the reference wire.
Figure 4:
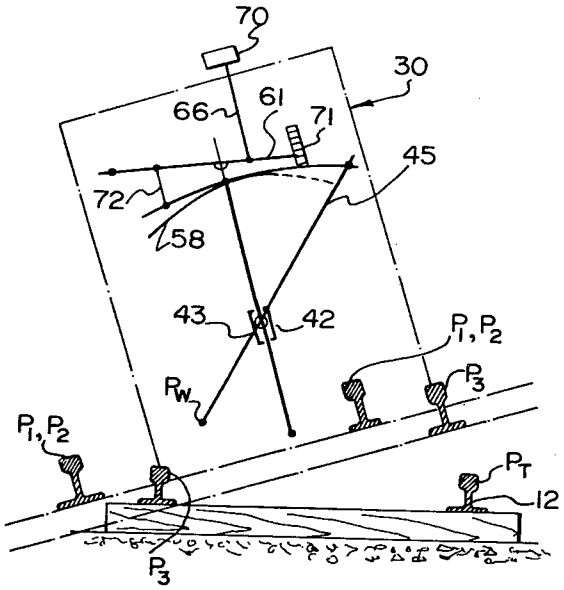
FIG. 4 is a diagrammatic representation of how the device shown in FIG. 2 operates in super elevated track.

However, when the track enters curves and becomes super elevated the position of the wire 21 to the indicator mechanism 30 is altered as seen in FIGS. 4 and 5. The front buggy carrying the wire and the rear buggy 23 carrying the wire 21 will, in a curve, move, from the tangent position $P_T$ in which all elements are in line and level, to positions P1, P2. In this position the wire is displaced sideways relative to the center of the mechanism 30 which will occupy position P3 (see FIG. 4). Further since the track in curves is super elevated, the wire, because of its sideways displacement, will be at a different vertical height to the height at which it would be in normal tangent track relative to the point of measurement. The wire will in fact occupy position *Pw* at the point of measurement. Fore, before the mechanism 36 of the present invention is able to measure track discrepancies, it is necessary to compensate for the relative vertical change in position of the wire. This is accomplished by turning the knob 70 to move the beam 61 clockwise or counterclockwise to the required position, which in turn lifts or depresses the link 72 to rotate the arcuate plate 55 clockwise or counterclockwise about its pivot 56. Since the dimensions of the link 72 and its pivot points 73 and 74 relative to the beam 61 and the arcuate plate 55 with its pivot point 56 have been empirically derived to compensate for this variation in wire position, the operator, even in curves still reads his surface condition from the scale 77 on the pointer 45 against the scribed line 58, which by operating knob 70 has been moved to provide the desired compensation. Alignment condition, as in tangent track in still read by pointer position against the calibrated scale 51 the shape of which has already be compensated, when drawn, for this change in wire position.

For a curve alignment operation, the operator may as is known in the art, first pass the machine 10 through the curve and draw a graph thereof. The desired curve form may then be superimposed by drawing over the graph. Thereafter the operator may pass the machine through the curve once again, aligning the track to the desired corrected curve.

Of course, it is to be understood that the need for the link 72 and the pivoting of the plate 55 could be eliminated if the plate 55 were simply replaced by a plate which, cam-fashion has been preshaped to provide the optimum position of the line 58 for the given curve being worked and its super elevation condition which is concurrently measured. This would probably require the machine operator to carry a series of such optimum line plates for each condition of track that he is going to meet, that is to say for each curve and super elevation condition that he will encounter during a days operation.

What I claim as my invention is:

1. A reference system having a reference wire tautly extended along a railroad track between front and rear anchor points, an indicator mechanism for an apparatus for correcting the existing grade and horizontal alignment of railroad track, said mechanism comprising frame means, the position of said frame means in use being referenced to the existing position of an adjacent section of the railroad track, pivot means mounted for vertical, sliding movement on said frame means, a needle indicator mounted on said pivot means to pivot about a horizontal axis generally parallel to the reference wire, index means arranged on said frame means to indicate in combination with said needle indicator the existing grade and horizontal alignment of said adjacent section with reference to said reference wire the position of said needle indicator being adjusted by said reference wire in contact with said needle indicator.

2. An indicator mechanism according to claim 1 wherein said reference wire extends through a relatively small hole in the bottom portion of said needle indicator.

3. An indicator mechanism according to claim 2, wherein said index means arranged on said frame comprises two separate indices, one to indicate the existing grade and the other to indicate the horizontal alignment of said adjacent section.

4. An indicator mechanism according to claim 3 wherein one of said indices is an arcuate line scribed on an adjustable plate mounted on said frame, said needle indicator carrying a graduated scale to be read against said line and (said other index) the other of said indices comprises a scale scribed on a plate of said frame which scale extends generally horizontally along an arc of a circle the center of which is located on the center line of the frame means taken in transverse direction.

5. An indicator mechanism according to claim 4 wherein said adjustable plate is pivotally mounted to said frame and a compensating linkage is provided to adjust the position of said adjustable plate to accommodate for wire system displacement in curved track operations.

6. An indicator mechanism according to claim 4 including a cross-level device mounted on said frame means to indicate the attitude of said frame means in a plane extending transversely to said railroad track.

7. An indicator mechanism according to claim 3 wherein one of said indices is a first scale extending vertically along and adjacent to an upper portion of said needle indicator and the other index comprises a second scale scribed on a plate of said frame which scale extends generally horizontally along an arc of a circle the center of which is located on the center line of the frame means taken in transverse direction.

8. An indicator mechanism according to claim 4 including an arcshaped member affixed to the upper portion of said needle indicator adjacent said first scale, the vertical position of said member relative to said first scale indicating the existing grade of said adjacent section.

9. In an apparatus for correcting the grade and horizontal alignment of a railroad track the combination of a reference wire tautly extended along a railroad track between front and rear anchor points, and an indicator mechanism comprising frame means, the position of said frame means in use being referenced to the existing position of an adjacent section of the railroad track, pivot means mounted for vertical, sliding movement in guides on said frame means, a needle indicator mounted on said pivot means to pivot about a horizontal axis generally parallel to the wire, scale means arranged on said frame to indicate in combination with said needle indicator the existing grade and horizontal alignment of said adjacent section with reference to said reference wire, the position of said needle indicator being adjusted by said reference wire in contact with said needle indicator.

10. An apparatus for correcting the grade and horizontal alignment of railroad track according to claim 9 wherein said reference wire extends through a relatively small hole in the bottom portion of said needle indicator.

11. An apparatus for correcting the grade and horizontal alignment of railroad track according to claim 10 including a railroad vehicle having means for adjusting the vertical and horizontal positon of said adjacent section of track, said mechanism being mounted near the front end of said vehicle.

12. A wire reference having a datum wire tautly extended along a railroad track between front and rear anchor points, a track condition indicator mechanism comprising frame means referenced to the track and pointer means pivotally mounted on said frame means to pivot about a horizontal axis generally parallel to the datum wire; index means for track grade and horizontal alignment arranged in said indicator mechanism; said pointer, in operation, being in operative contact with said datum wire at a point beneath its pivot so that track condition in grade and horizontal alignment relative to said datum wire are registered by the relative positions of said pointer, frame and datum wire.

* * * * *